US006569315B2

(12) United States Patent
Stuntz et al.

(10) Patent No.: US 6,569,315 B2
(45) **Date of Patent: *May 27, 2003**

(54) CYCLE OIL CONVERSION PROCESS

(75) Inventors: Gordon F. Stuntz, Baton Rouge, LA (US); George A. Swan, III, Baton Rouge, LA (US); William E. Winter, Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 5 days.

This patent is subject to a terminal disclaimer.

(21) Appl. No.: 09/811,168

(22) Filed: Mar. 16, 2001

(65) Prior Publication Data

US 2001/0054571 A1 Dec. 27, 2001

Related U.S. Application Data

(60) Provisional application No. 60/197,919, filed on Apr. 17, 2000.

(51) Int. Cl.[7] ..... C10G 51/02

(52) U.S. Cl. ..... 208/77; 208/74; 208/72

(58) Field of Search ..... 208/72, 74, 77

(56) References Cited

U.S. PATENT DOCUMENTS

| | | | | | |
|---|---|---|---|---|---|
| 2,890,164 | A | | 6/1959 | Woertz | 208/74 |
| 3,065,166 | A | | 11/1962 | Henning | 208/67 |
| 3,479,279 | A | | 11/1969 | Pohlenz | 208/56 |
| 3,489,673 | A | | 1/1970 | Stine et al. | 208/73 |
| 3,533,936 | A | | 10/1970 | Weisz | 208/56 |
| 3,536,609 | A | | 10/1970 | Stine et al. | 208/72 |
| 3,617,497 | A | | 11/1971 | Bryson | 208/80 |
| 3,630,886 | A | | 12/1971 | Deed et al. | 208/96 |
| 3,692,667 | A | | 9/1972 | McKinney et al. | 208/120 |
| 3,761,391 | A | | 9/1973 | Conner | 208/76 |
| 3,803,024 | A | | 4/1974 | Haunschild | 208/76 |
| 3,886,060 | A | | 5/1975 | Owen | 208/120 |
| 3,893,905 | A | * | 7/1975 | Fenske et al. | 203/87 |
| 3,894,933 | A | | 7/1975 | Owen et al. | 208/77 |
| 3,928,172 | A | | 12/1975 | Davis, Jr. et al. | 208/77 |
| 4,051,013 | A | | 9/1977 | Strother | 208/78 |
| 4,239,654 | A | | 12/1980 | Gladrow et al. | 252/455 Z |
| 4,267,072 | A | | 5/1981 | Vasalos | 252/455 |
| 4,388,175 | A | | 6/1983 | Lionetti et al. | 208/74 |
| 4,490,241 | A | | 12/1984 | Chou | 208/75 |
| 4,585,545 | A | | 4/1986 | Yancey, Jr. et al. | 208/74 |
| 4,750,988 | A | | 6/1988 | Mitchell et al. | 208/118 |
| 4,775,461 | A | | 10/1988 | Harris et al. | 208/120 |
| 4,794,095 | A | | 12/1988 | Walker et al. | 502/64 |
| 4,846,960 | A | | 7/1989 | Walker et al. | 208/119 |
| 4,892,643 | A | | 1/1990 | Herbst et al. | 208/70 |
| 4,968,405 | A | | 11/1990 | Wachter | 208/120 |
| 5,043,522 | A | | 8/1991 | Leyshon et al. | 585/651 |
| 5,098,554 | A | | 3/1992 | Krishna et al. | 208/113 |
| 5,139,648 | A | | 8/1992 | Lambert | 208/111 |
| 5,152,883 | A | | 10/1992 | Melin et al. | 208/61 |
| 5,176,815 | A | | 1/1993 | Lomas | 208/78 |
| 5,243,121 | A | | 9/1993 | Madon et al. | 585/649 |
| 5,278,114 | A | | 1/1994 | Wielers et al. | 502/67 |
| 5,318,689 | A | | 6/1994 | Hsing et al. | 208/70 |
| 5,389,232 | A | | 2/1995 | Adewuyi et al. | 208/120 |
| 5,582,711 | A | * | 12/1996 | Ellis et al. | 208/100 |
| 5,770,043 | A | * | 6/1998 | Ellis et al. | 208/100 |
| 5,770,044 | A | * | 6/1998 | Ellis et al. | 208/100 |
| 5,846,403 | A | | 12/1998 | Swan et al. | 208/113 |
| 5,944,982 | A | | 8/1999 | Lomas | 208/164 |
| 6,106,697 | A | * | 8/2000 | Swan et al. | 208/67 |
| 6,123,830 | A | * | 9/2000 | Gupta et al. | 208/57 |
| 6,258,257 | B1 | * | 7/2001 | Swan et al. | 208/72 |

FOREIGN PATENT DOCUMENTS

| | | |
|---|---|---|
| CA | 852713 | 9/1970 |
| CA | 863912 | 2/1971 |
| CA | 935110 | 10/1973 |
| DE | 248516 | 8/1987 |
| DE | 4114874 | 11/1991 |
| EP | 0101553 | 2/1984 |
| EP | 0369536 | 5/1990 |
| EP | 0391528 | 10/1990 |
| EP | 0825243 | 2/1998 |
| EP | 0825244 | 2/1998 |
| WO | WO90/15121 | 12/1990 |

* cited by examiner

*Primary Examiner*—Walter D. Griffin
(74) *Attorney, Agent, or Firm*—Gerard J. Hughes; Erika Singleton Wilson

(57) ABSTRACT

The invention relates to a process for converting cycle oils produced in catalytic cracking reactions into olefinic naphthas. More particularly, the invention relates to a process for hydroprocessing a catalytically cracked light cycle oil, and then re-cracking in an out-board FCC reactor it in order to form a naphthenic blend-stock.

12 Claims, No Drawings

CYCLE OIL CONVERSION PROCESS

CROSS-REFERENCE TO RELATED APPLICATIONS

This patent application claims benefit of U.S. provisional patent application 60/197,919 filed Apr. 17, 2000.

FIELD OF THE INVENTION

The present invention relates to a process for converting cycle oils produced in catalytic cracking reactions into olefinic naphthas. More particularly, the invention relates to an out-board process for converting a catalytically cracked cycle oil such as heavy cycle oil ("HCO" or "HCCO"), light cycle oil ("LCO" or "LCCO"), and mixtures thereof into olefins and naphthas using a zeolite catalyst.

BACKGROUND OF THE INVENTION

Cycle oils such as LCCO produced in fluidized catalytic cracking ("FCC") reactions contain two-ring aromatic species such as naphthalene. The need for blendstocks for forming low emissions fuels has created an increased demand for FCC products that contain a diminished concentration of multi-ring aromatics. There is also an increased demand for FCC products containing light olefins that may be separated for use in alkylation, oligomerization, polymerization, and MTBE and ETBE synthesis processes. There is a particular need for low emissions, high octane FCC products having an increased concentration of $C_2$ to $C_4$ olefins and a reduced concentration of multi-ring aromatics and olefins of higher molecular weight.

Hydrotreating a cycle oil and re-cracking hydrotreated cycle oil results in conversion of the cycle oil to a motor gasoline blend-stock. The hydrotreated cycle oil may be recycled to the FCC unit from which it was derived, or it may be may be re-cracked in an additional catalytic cracking unit.

Hydrotreating cycle oil such as LCCO partially saturates bicyclic hydrocarbons such as naphthalene to produce tetralin. Hydrotreatment and subsequent LCCO re-cracking may occur in the primary reactor vessel. Hydrotreated LCCO may also be injected into the FCC feed riser at a point downstream of feed injection to provide for feed quenching. Unfortunately, such re-cracking of hydrotreated LCCO results in undesirable hydrogen transfer reactions that convert species such as tetralin into aromatics such as naphthalene.

There remains a need, therefore, for new processes for forming naphthenic blendstocks from hydrotreated cycle oils such as LCCO.

SUMMARY OF THE INVENTION

In one embodiment, the invention is a method for catalytically cracking a cycle oil comprising:

(a) catalytically cracking a primary feed in a first FCC riser reactor under catalytic cracking conditions in the presence of a first catalytic cracking catalyst in order to form a cracked product;

(b) separating at least a cycle oil from the cracked product;

(c) injecting the cycle oil into a second FCC riser reactor; and (d) cracking the cycle oil under cycle oil catalytic cracking conditions in the presence of a second catalytic cracking catalyst.

DETAILED DESCRIPTION OF THE INVENTION

The invention is based on the discovery that re-cracking a cycle oil such as LCCO in a second riser reactor results in beneficial conversion of the cycle oil into naphtha and light olefins such as propylene. It is believed that injecting the cycle oil into the second reactor suppresses undesirable hydrogen transfer reactions that would otherwise occur if the cycle oil were re-cracked in the first FCC reactor. Re-cracking in a second reactor under cycle oil cracking conditions (i.e. conditions that exclude gas oils and residual oils from the reaction zone) substantially eliminates hydrogen transfer reactions between hydrogen donors present in the cycle oil and hydrogen acceptors present in the gas oil or residual oil. Preferably, the cycle oil is hydroprocessed before re-cracking because hydrogen transfer reactions are further suppressed when the cyclic and multi-cyclic species present in the cycle oil are at least partially saturated. More preferably, the cycle oil is hydroprocessed to form a significant amount of decahydronaphthalene in the hydroprocessed product because the related naphthalene and tetrahydronaphthalene species are not as readily re-cracked into light olefins. Optionally, the hydrotreated LCCO is combined with naphtha before re-cracking. The naphtha may be, for example, one or more of a thermally or catalytically cracked naphtha obtained from an FCC unit, coker, or steam cracker.

Preferred hydrocarbonaceous feeds (i.e. the primary feed) for the catalytic cracking process described herein include naphtha, hydrocarbonaceous oils boiling in the range of about 430° F. (220° C.) to about 1050° F. (565° C.), such as gas oil; heavy hydrocarbonaceous oils comprising materials boiling above 1050° F. (565° C.); heavy and reduced petroleum crude oil; petroleum atmospheric distillation bottoms; petroleum vacuum distillation bottoms; pitch, asphalt, bitumen, other heavy hydrocarbon residues; tar sand oils; shale oil; liquid products derived from coal and natural gas, and mixtures thereof.

Cycle oil formation, in accord with this invention, may occur in one or more conventional FCC process units under conventional FCC conditions in the presence of conventional FCC catalyst. Each unit comprises a riser reactor having a reaction zone, a stripping zone, a catalyst regeneration zone, and at least one fractionation zone. The primary feed is conducted to the riser reactor where it is injected into the reaction zone wherein the primary feed contacts a flowing source of hot, regenerated catalyst. The hot catalyst vaporizes and cracks the feed at a temperature from about 500° C. to about 650° C., preferably from about 500° C. to about 600° C. The cracking reaction deposits carbonaceous hydrocarbons, or coke, on the catalyst, thereby deactivating the catalyst. The cracked products may be separated from the coked catalyst and a portion of the cracked products may be conducted to a fractionator. The fractionator separates at least a cycle oil fraction, preferably an LCCO fraction, from the cracked products.

The coked catalyst flows through the stripping zone where volatiles are stripped from the catalyst particles with a stripping material such as steam. The stripping may be preformed under low severity conditions in order to retain adsorbed hydrocarbons for heat balance. The stripped catalyst is then conducted to the regeneration zone where it is regenerated by burning coke on the catalyst in the presence of an oxygen containing gas, preferably air. Decoking restores catalyst activity and simultaneously heats the catalyst to, e.g., 650° C. to 750° C. The hot catalyst is then recycled to the riser reactor at a point near or just upstream of the second reaction zone. Flue gas formed by burning coke in the regenerator may be treated for removal of particulates and for conversion of carbon monoxide, after which the flue gas is normally discharged into the atmosphere.

The primary feed may be cracked under conventional FCC conditions in the presence of a first fluidized catalytic cracking catalyst. Preferred process conditions in the reaction zone include temperatures from about 500° C. to about 650° C., preferably from about 525° C. to 600° C.; hydrocarbon partial pressures from about 10 to 40 psia, preferably from about 20 to 35 psia; and a catalyst to primary feed (wt/wt) ratio from about 3 to 12, preferably from about 4 to 10; where catalyst weight is total weight of the catalyst composite. Though not required, it is also preferred that steam be concurrently introduced with the primary feed into the reaction zone, with the steam comprising up to about 10 wt. %, and preferably ranging from about 2 wt. % to about 3 wt. % of the primary feed. Also, it is preferred that the primary feed's residence time in the reaction zone be less than about 10 seconds, for example from about 1 to 10 seconds.

Any conventional FCC catalyst may be used for primary feed cracking. Such catalysts are set forth, for example, in U.S. Pat. No. 5,318,694, incorporated by reference herein.

In one embodiment, at least a cycle oil fraction is separated from the cracked products of the primary FCC unit, and at least a portion thereof is hydroprocessed. Cycle oil hydroprocessing may occur in one or more hydroprocessing reactors under hydroprocessing conditions in the presence of a hydroprocessing catalyst. Cycle oil hydroprocessing is preferred in cases where the second cracking catalyst contains a species having a shape selective zeolite.

In a preferred embodiment, at least an LCCO is separated from the cracked product of primary feed cracking in the primary FCC unit, and at least a portion of the LCCO is hydroprocessed in a first hydroprocessing reaction. Hydroprocessed LCCO is conducted to a secondary (i.e. an outboard) FCC unit, such as an FCC riser-reactor, wherein the LCCO is cracked under cycle oil cracking conditions into cracked products. Naphtha may also be separated from the cracked products of the primary FCC unit. In one embodiment, at least a portion of the separated naphtha is combined with the hydroprocessed cycle oil prior to injection into the secondary (i.e. outboard) FCC unit.

The term "hydroprocessing" is used broadly herein, and includes for example hydrogenation such as aromatics saturation, hydrotreating, hydrofining, and hydrocracking. As is known by those of skill in the art, the degree of hydroprocessing can be controlled through proper selection of catalyst as well as by optimizing operation conditions. It is desirable that the hydroprocessing convert unsaturated hydrocarbons such as olefins and diolefins to paraffins using a typical hydrogenation catalyst. Objectionable species can also be removed by the hydroprocessing reactions. These species include non-hydrocarbyl species that may contain sulfur, nitrogen, oxygen, halides, and certain metals.

Cycle oil hydroprocessing may be performed under conventional hydroprocessing conditions. Accordingly, the reaction is performed at a temperature ranging from about 400° to about 900° F., more preferably from about 600° to about 850° F. The reaction pressure preferably ranges from about 100 to about 3000 psig, more preferably from about 300 to about 1500 psig. The hourly space velocity preferably ranges from about 0.1 to about 6 V/V/Hr, more preferably from about 0.3 to about 2 V/V/Hr, where V/V/Hr is defined as the volume of oil per hour per volume of catalyst. The hydrogen containing gas is preferably added to establish a hydrogen charge rate ranging from about 500 to about 15,000 standard cubic feet per barrel (SCF/B), more preferably from about 500 to about 5000 SCF/B.

As discussed, it is preferable that the hydroprocessing conditions be selected to produce a significant amount of decahydronaphthalene and alkyl-functionalized derivatives thereof in the hydroprocessed product. More preferably, derivatives of decahydronaphthalene boiling above 220° C. are substantially absent.

It is also preferred that decahydronaphthalene be the most abundant species among the cyclic and multi-cyclic species present in the hydroprocessed cycle oil. Still more preferably, the hydroprocessing is conducted so that decahydronaphthalene is the most abundant 2-ring species in the hydroprocessed cycle oil. Preferably, the total aromatics content in the hydroprocessed cycle oil ranges from about 0 to about 5 wt. %, with a total 2-ring or larger aromatic content ranging from about 0 to about 2 wt. %. Still more preferably, the total aromatics content in the hydroprocessed cycle oil ranges from about 0 to about 0.6 wt. %, with a total 2-ring or larger aromatic content ranging from about 0 to about 0.01 wt. %.

Accordingly, hydroprocessing is preferably performed in one or more stages consistent with the objective of maximizing conversion of multi-ring aromatics species (e.g., naphthalenes) to the corresponding fully saturated species (e.g., decahydronaphthalene). For a single-stage operation, the reaction is performed at a temperature ranging from about 200° C. to about 550° C., more preferably from about 250° C. to about 400° C. The reaction pressure preferably ranges from about 1000 to about 3000 psig, more preferably from about 1200 to about 2500 psig, and still more preferably from about 1300 to about 2000 psig. The space velocity preferably ranges from about 0.1 to 6 V/V/Hr, more preferably from about 0.5 to about 2 V/V/Hr, and still more preferably from about 0.8 to about 2 V/V/Hr, where V/V/Hr is defined as the volume of oil per hour per volume of catalyst. The hydrogen containing gas is preferably added to establish a hydrogen charge rate ranging from about 1,000 to about 15,000 standard cubic feet per barrel (SCF/B), more preferably from about 5,000 to about 10,000 SCF/B. Actual conditions employed will depend on factors such as feed quality and catalyst, but should be consistent with the objective of maximizing conversion of multi-ring aromatic species to decahydronaphthalene. For a two-stage operation wherein LCCO is first hydroprocessed to remove substantial amounts of sulfur and nitrogen, and convert bicyclic aromatics such as naphthalenes predominantly to partially saturated tetralins such as tetrahydronaphthalene. The second-stage hydrogenation reaction is performed at a temperature ranging from about 100° C. to about 600° C., preferably from about 100° C. to about 450° C., and more preferably from about 200° C. to about 400° C. The reaction pressure preferably ranges from about 100 to about 3000 psig, more preferably from about 450 to about 2000 psig, and still more preferably from about 1300 psig to about 2000 psig. The space velocity preferably ranges from about 0.1 to 6 V/NV/Hr, preferably about 0.8 to about 2 V/V/Hr, where V/V/Hr is defined as the volume of oil per hour per volume of catalyst. The hydrogen containing gas is preferably added to establish a hydrogen charge rate ranging from about 500 to about 15,000 standard cubic feet per barrel (SCF/B), more preferably from about 500 to about 10,000 SCF/B. Actual conditions employed will depend on factors such as feed quality and catalyst, but should be consistent with the objective of maximizing the concentration of decahydronaphthalene.

Hydroprocessing conditions can be maintained by use of any of several types of hydroprocessing reactors. Trickle bed reactors are most commonly employed in petroleum refining applications with co-current downflow of liquid and gas phases over a fixed bed of catalyst particles. It can be advantageous to utilize alternative reactor technologies. Countercurrent-flow reactors, in which the liquid phase passes down through a fixed bed of catalyst against upward-moving treat gas, can be employed to obtain higher reaction rates and to alleviate aromatics hydrogenation equilibrium limitations inherent in co-current flow trickle bed reactors. Moving bed reactors can be employed to increase tolerance for metals and particulates in the hydroprocessor feed stream. Moving bed reactor types generally include reactors wherein a captive bed of catalyst particles is contacted by upward-flowing liquid and treat gas. The catalyst bed can be slightly expanded by the upward flow or substantially expanded or fluidized by increasing flow rate, for example, via liquid recirculation (expanded bed or ebullating bed), use of smaller size catalyst particles which are more easily fluidized (slurry bed), or both. In any case, catalyst can be removed from a moving bed reactor during onstream operation, enabling economic application when high levels of metals in feed would otherwise lead to short run lengths in the alternative fixed bed designs. Furthermore, expanded or slurry bed reactors with upward-flowing liquid and gas phases would enable economic operation with feedstocks containing significant levels of particulate solids, by permitting long run lengths without risk of shutdown due to fouling. Use of such a reactor would be especially beneficial in cases where the feedstocks include solids in excess of about 25 micron size, or contain contaminants which increase the propensity for foulant accumulation, such as olefinic or diolefinic species or oxygenated species. Moving bed reactors utilizing downward-flowing liquid and gas can also be applied, as they would enable on-stream catalyst replacement.

A hydroprocessing catalyst suitable for aromatic saturation, desulfurization, denitrogenation or any combination thereof may be used for cycle oil hydroprocessing. Preferably, the catalyst is comprised of at least one Group VIII metal, optionally in combination with a Group VI metal, on an inorganic refractory support, which is preferably alumina or alumina-silica. The Group VIII and Group VI compounds are well known to those of ordinary skill in the art and are well defined in the Periodic Table of the Elements. For example, these compounds are listed in the Periodic Table found at the last page of Advanced Inorganic Chemistry, 2nd Edition 1966, Interscience Publishers, by Cotton and Wilkenson. The Group VIII metal is preferably present in an amount ranging from 2–20 wt. %, preferably 4–12 wt. %. Preferred Group VIII metals include Pt, Co, Ni, and Fe, with Pt, Co, and Ni being most preferred. The preferred Group VI metal is Mo which is present in an amount ranging from 5–50 wt. %, preferably 10–40 wt. %, and more preferably from 20–30 wt. %.

All metals weight percents given are on support. The term "on support" means that the percents are based on the weight of the support. For example, if a support weighs 100 g, then 20 wt. % Group VIII metal means that 20 g of the Group VIII metal is on the support.

Any suitable inorganic oxide support material may be used for the hydroprocessing catalyst of the present invention. Preferred are alumina and silica-alumina, including crystalline alumino-silicate such as zeolite. More preferred is alumina. The silica content of the silica-alumina support can be from 2–30 wt. %, preferably 3–20 wt. %, more preferably 5–19 wt. %. Other refractory inorganic compounds may also be used, non-limiting examples of which include zirconia, titania, magnesia, and the like. The alumina can be any of the aluminas conventionally used for hydroprocessing catalysts. Such aluminas are generally porous amorphous alumina having an average pore size from 50–200 A, preferably, 70–150 A, and a surface area from 50–450 $m^2/g$.

The product of cycle oil hydroprocessing may be injected into a second catalytic cracking zone for re-cracking to form products such as naphtha and light olefins. Accordingly, the cycle oil may be cracked into lower molecular weight cracked products while supressing undesirable hydrogen transfer reactions. Cracked products formed in the second (i.e. the out-board) reactor include naphtha in amounts ranging from about 5 wt. % to about 60 wt. %, butanes in amounts ranging from about 0.5 wt. % to about 15 wt. %, butenes in amounts ranging from about 4 wt. % to about 10 wt. %, propane in amounts ranging from about 0.5 wt. % to about 3.5 wt. %, and propylene in amounts ranging from about 5 wt. % to about 15 wt. %. All wt. % are based on the total weight of the cracked product. Preferably, at least 90 wt. % of the cracked products have boiling points less than about 430° F. While not wishing to be bound by any theory, it is believed that the substantial concentration of propylene in the cracked product results from the hydroprocessed LCCO cracking in the second reaction zone.

Accordingly, the hydroprocessed cycle oil may be cracked under appropriate cycle oil cracking conditions in a second FCC reactor in the presence of a second catalytic cracking catalyst. Appropriate cycle oil cracking conditions in the reactor's reaction zone include temperatures from about 495° C. to about 700° C., preferably from about 525° C. to 650° C.; hydrocarbon partial pressures from about 10 to 40 psia, preferably from about 20 to 35 psia; and a catalyst to cycle oil (wt/wt) ratio from about 2 to 100, preferably from about 4 to 50; where catalyst weight is total weight of the catalyst composite. Though not required, it is also preferred that steam be concurrently introduced with the cycle oil into the reaction zone, with the steam comprising up to about 50 wt. % of the primary feed. Also, it is preferred that the cycle oil's residence time in the reaction zone be less than about 20 seconds, for example from about 0.1 to 10 seconds.

The second fluidized catalytic cracking catalyst ("second catalyst" herein) may be a conventional FCC catalyst. As such, it may be a composition of catalyst particles and other reactive and non-reactive components. More than one type of catalyst particle may be present in the second catalyst. A preferred catalyst particle useful in the invention contains at least one crystalline aluminosilicate, also referred to as zeolite, of average pore diameter greater than about 0.7 nanometers (nm), i.e. large pore zeolite cracking catalyst. The pore diameter also sometimes referred to as effective pore diameter can be measured using standard adsorption techniques and hydrocarbons of known minimum kinetic diameters. See Breck, *Zeolite Molecular Sieves,* 1974 and Anderson et al., J. Catalysis 58, 114 (1979), both of which are incorporated herein by reference. Zeolites useful in the second catalyst are described in the "Atlas of Zeolite Structure Types", eds. W. H. Meier and D. H. Olson, Butterworth-Heineman, Third Edition, 1992, which is hereby incorporated by reference. As discussed, the second catalyst may be in the form of particles containing zeolite. The second catalyst may also include fines, inert particles, particles containing a metallic species, and mixtures thereof. Particles containing metallic species include platinum compounds, platinum metal, and mixtures thereof.

The second catalyst particles may contain metals such as platinum, promoter species such as phosphorous-containing species, clay filler, and species for imparting additional catalytic functionality (additional to the cracking functionality) such as bottoms cracking and metals passivation. Such an additional catalytic functionality may be provided, for example, by aluminum-containing species. More than one type of catalyst particle may be present in the catalyst. For example, individual catalyst particles may contain large pore zeolite, shape selective zeolite, and mixtures thereof.

The cracking catalyst particle may be held together with an inorganic oxide matrix component. The inorganic oxide matrix component binds the particle's components together so that the catalyst particle product is hard enough to survive interparticle and reactor wall collisions. The inorganic oxide matrix may be made according to conventional methods from an inorganic oxide sol or gel which is dried to "glue" the catalyst particle's components together. Preferably, the inorganic oxide matrix is not catalytically active and comprises oxides of silicon and aluminum. It is also preferred that separate alumina phases be incorporated into the inorganic oxide matrix. Species of aluminum oxyhydroxides-g-alumina, boehmite, diaspore, and transitional aluminas such as a-alumina, b-alumina, g-alumina, d-alumina, e-alumina, k-alumina, and r-alumina can be employed. Preferably, the alumina species is an aluminum trihydroxide such as gibbsite, bayerite, nordstrandite, or doyelite. The matrix material may also contain phosphorous or aluminum phosphate.

Preferred catalyst particles in the second catalyst contain at least one of:

(a) amorphous solid acids, such as alumina, silica-alumina, silica-magnesia, silica-zirconia, silica-thoria, silica-beryllia, silica-titania, and the like; and (b) zeolite catalysts containing faujasite.

Silica-alumina materials suitable for use in the present invention are amorphous materials containing about 10 to 40 wt. % alumina and to which other promoters may or may not be added.

Suitable zeolite in such catalyst particles include zeolites which are iso-structural to zeolite Y. These include the ion-exchanged forms such as the rare-earth hydrogen and ultra stable (USY) form. The zeolite may range in size from about 0.1 to 10 microns, preferably from about 0.3 to 3 microns. The zeolite will be mixed with a suitable porous matrix material in order to form the fluid catalytic cracking catalyst. Non-limiting porous matrix materials which may be used in the practice of the present invention include alumina, silica-alumina, silica-magnesia, silica-zirconia, silica-thoria, silica-beryllia, silica-titania, as well as ternary compositions, such as silica-alumina-thoria, silica-alumina-zirconia, magnesia and silica-magnesia-zirconia. The matrix may also be in the form of a cogel. The relative proportions of zeolite component and inorganic oxide gel matrix on an anhydrous basis may vary widely with the zeolite content, ranging from about 10 to 99, more usually from about 10 to 80, percent by weight of the dry composite. The matrix itself may possess catalytic properties, generally of an acidic nature.

The amount of zeolite component in the catalyst particle will generally range from about 1 to about 60 wt. %, preferably from about 1 to about 40 wt. %, and more preferably from about 5 to about 40 wt. %, based on the total weight of the catalyst. Generally, the catalyst particle size will range from about 10 to 300 microns in diameter, with an average particle diameter of about 60 microns. The surface area of the matrix material will be about .≦.350 $m^2/g$, preferably 50 to 200 $m^2/g$, more preferably from about 50 to 100 $m^2/g$. While the surface area of the final catalysts will be dependent on such things as type and amount of zeolite material used, it will usually be less than about 500 $m^2/g$, preferably from about 50 to 300 $m^2/g$, more preferably from about 50 to 250 $m^2/g$, and most preferably from about 100 to 250 $m^2/g$.

Another preferred second catalyst contains a mixture of zeolite Y and zeolite beta. The Y and beta zeolite may be on the same catalyst particle, on different particles, or some combination thereof. Such catalysts are described in U.S. Pat. No. 5,314,612, incorporated by reference herein. Such catalyst particles consist of a combination of zeolite Y and zeolite beta combined in a matrix comprised of silica, silica-alumina, alumina, or any other suitable matrix material for such catalyst particles. The zeolite portion of the resulting composite catalyst particle will consist of 25 to 95 wt. % zeolite Y with the balance being zeolite beta.

Yet another preferred second catalyst contains a mixture of zeolite Y and a shape selective zeolite species such as ZSM-5 or a mixture of an amorphous acidic material and ZSM-5. The Y zeolite( or alternatively the amorphous acidic material) and shape selective zeolite may be on the same catalyst particle, on different particles, or some combination thereof. Such catalysts are described in U.S. Pat. No. 5,318,692, incorporated by reference herein. The zeolite portion of the catalyst particle will typically contain from about 5 wt. % to 95 wt. % zeolite-Y (or alternatively the amorphous acidic material) and the balance of the zeolite portion being ZSM-5

Shape selective zeolite species useful in the second catalyst include medium pore size zeolites generally having a pore size from about 0.5 nm, to about 0.7 nm. Such zeolites include, for example, MFI, MFS, MEL, MTW, EUO, MTT, HEU, FER, and TON structure type zeolites (IUPAC Commission of Zeolite Nomenclature). Non-limiting examples of such medium pore size zeolites, include ZSM-5, ZSM-12, ZSM-22, ZSM-23, ZSM-34, ZSM-35, ZSM-38, ZSM-48, ZSM-50, silicalite, and silicalite 2. The most preferred is ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference.

Other suitable medium pore size zeolites include the silicoaluminophosphates (SAPO), such as SAPO-4 and SAPO-11 which is described in U.S. Pat. No. 4,440,871; chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651; and iron aluminosilicates.

The large pore and shape selective zeolites in the catalytic species can include "crystalline admixtures" which are thought to be the result of faults occurring within the crystal or crystalline area during the synthesis of the zeolites. Examples of crystalline admixtures of ZSM-5 and ZSM-11 are disclosed in U.S. Pat. No. 4,229,424 which is incorporated herein by reference. The crystalline admixtures are themselves medium pore, i.e. shape selective, size zeolites and are not to be confused with physical admixtures of zeolites in which distinct crystals of crystallites of different zeolites are physically present in the same catalyst composite or hydrothermal reaction mixtures.

As set forth above, the process of the invention comprises cracking a primary feed in a first FCC riser reactor in order to form a cracked product. At least a portion of the cycle oil is separated from the cracked product for injection into a second FCC reactor. The cycle oil may be combined with naphtha derived, for example, from catalytic cracking or thermal cracking processes, prior to injection into the second reactor. Preferably, at least a portion of the cycle oil, preferably at least a portion of the LCCO, is hydroprocessed prior to injection into the second reactor's reaction zone. Cycle oil cracking in the second reactor results in cracked products having substantial concentrations of naphtha and light, i.e. $C_2$ to $C_4$, olefins.

In a preferred embodiment, naphtha species and light olefin species in the $C_2$ to $C_4$ range may be separated from the secondary reactor's cracked product for storage or further processing. Light olefins, such as propylene, separated from the process may be used as feeds for processes such as oligimerization, polymerization, co-polymerization, ter-polymerization, and related processes (hereinafter "polymerization") in order to form macromolecules. Such light olefins may be polymerized both alone and in combination with other species, in accordance with polymerization methods known in the art. In some cases it may be desirable to separate, concentrate, purify, upgrade, or otherwise process the light olefins prior to polymerization. Propylene and ethylene are preferred polymerization feeds. Polypropylene and polyethylene are preferred polymerization products made therefrom.

EXAMPLES

Example 1

This example demonstrates that hydroprocessing conditions may be controlled to provided for a hydroprocessed cycle oil containing a significant amount of tetralins (Table 1, column 1) or under different hydrogenation conditions to produce significant amounts of decahydronaphthalene (Table 1, column 2). As set forth in Table 2, hydrogenation conditions to form decahydronaphthalene result in nearly complete saturation of aromatic species present in the cycle oil.

TABLE 1

| | Hydrogenation to form tetrahydro-naphthalene | Hydrogenation to form decahydro-naphthalene |
|---|---|---|
| Conditions | | |
| Catalyst | $NiMo/Al_2O_3$ | $Pt/Al_2O_3$ |
| Temperature ° F./° C. | 700/371 | 550/288 |
| Pressure (psig) | 1200 | 1800 |
| LHSV | 0.7 | 1.7 |
| $H_2$ Treat Gas Rate (SCF/B) | 5500 | 5000 |
| Product Properties | | |
| Boiling Point Distribution | | |
| 0.5 wt. % ° F./° C. | 224.6/107 | 219.7/104 |
| 50.0 wt. % ° F./° C. | 513.4/267 | 475.5/246 |
| 99.5 wt. % ° F./° C. | 720.4/382 | 725.4/385 |
| Gravity (° API) | 26.2 | 33.2 |
| Total Aromatics (wt. %) | 57.6 | 0.6 |
| One-Ring Aromatics (wt. %) | 43.1 | 0.6 |

TABLE 1-continued

| | Hydrogenation to form tetrahydro-naphthalene | Hydrogenation to form decahydro-naphthalene |
|---|---|---|
| Feedstock Properties | | |
| Boiling Point Distribution | | |
| 0.5 wt. % ° F./° C. | 299.8/149 | 224.6/107 |
| 50.0 wt. % ° F./° C. | 564.9/296 | 513.4/267 |
| 99.5 wt. % ° F./° C. | 727.8/387 | 720.4/382 |
| Gravity (° API) | 13.8 | 26.2 |
| Total Aromatics (wt. %) | 83.5 | 57.6 |
| One-Ring Aromatics (wt. %) | 9.7 | 43.1 |

Example 2

In one embodiment, the invention involves hydrotreating an LCCO obtained from a primary FCC unit, hydroprocessing the LCCO, and then re-cracking the LCCO in a secondary (outboard) FCC unit. This aspect of the invention is supported by tests set forth in table 3 that show a significant amount of propylene may produced by cracking hydroprocessed LCCO. Column 1 corresponds to an LCCO hydroprocessed to form a significant amount of tetralins in the hydroprocessed product. Columns 2 through 4 correspond to an LCCO hydroprocessed to form a significant amount of decahydronaphthalene in the hydroprocessed product.

Cracking conditions for the hydrotreated LCCO in the presence of catalytic cracking catalyst mixtures of large pore zeolite catalyst, shape selective zeolite catalysts such as ZSM-5, and mixtures thereof in a Microactivity Test Unit ("MAT")are set forth in Table 2. MAT tests and associated hardware are described in Oil and Gas 64, 7, 84, 85, 1966, and Oil and Gas, Nov. 22, 1971, 60–68.

Conditions used herein included temperature 550, 650° C., run time 0.5 sec., catalyst charge 4.0 g, feed volume 0.95–1.0 $cm^3$, and cat:oil ratio 4.0–4.2. Catalysts A and B are commercially available conventional large pore FCC catalysts containing Y-zeolite, while catalyst C is a ZSM-5-containing catalyst. As can be seen in the table, significant conversion to propylene was achieved in all cases. However, increased propylene yield was obtained when the LCCO was hydroprocessed to form a significant amount of decahydronaphthalene in the hydroprocessed product. Moreover, beneficial increases in propylene yield are obtained at higher reaction zone temperatures, i.e. about 1200° F., and when shape-selective catalyst is employed.

TABLE 2

| | | Saturated | Saturated | Saturated |
|---|---|---|---|---|
| Feed stock | H/T LCCO | LCCO | LCCO | LCCO |
| Catalyst | A | A | 20% B | C |
| (steamed) | | | 80% C | |
| Temp., F. | 1020 | 1020 | 1020 | 1020 |
| Cat Oil | 3.96 | 4.15 | 4.07 | 4.00 |
| Conversion | 81.2 | 93.3 | 87.0 | 49.1 |
| Yields, Wt % | | | | |
| C2-Dry Gas | 3.5 | 3.3 | 6.0 | 3.3 |
| Propylene | 5.4 | 7.1 | 14.1 | 6.2 |
| Propane | 1.9 | 2.3 | 3.2 | 0.7 |
| Butenes | 4.2 | 4.5 | 8.9 | 4.0 |
| Butanes | 8.8 | 13.2 | 10.8 | 0.8 |
| Naphtha | 53.2 | 59.8 | 42.2 | 33.4 |
| 430F.+ | 18.8 | 6.7 | 13.1 | 49.2 |
| Coke | 4.3 | 3.1 | 1.9 | 0.8 |

What is claimed is:

1. A catalytic cracking method, comprising:

(a) catalytically cracking a primary feed in a first catalytic cracking unit under catalytic cracking conditions in the presence of a first catalytic cracking catalyst in order to form a cracked product;

(b) separating at least a cycle oil from the cracked product and hydroprocessing at least a portion of the cycle oil in the presence of a catalytically effective amount of a hydroprocessing catalyst under hydroprocessing conditions in order to form a hydroprocessed cycle oil wherein derivatives of decahydronaphthalene boiling above 220° C. are substantially absent in the hydroprocessed cycle oil and wherein decahydronaphthalene is the most abundant species among the cyclic and multi-cyclic species present in the hydroprocessed cycle oil;

(c) conducting the hydroprocessed cycle oil to a second catalytic cracking unit; and (d) cracking the hydroprocessed cycle oil under cycle oil catalytic cracking conditions in the presence of a second catalytic cracking catalyst in the second catalytic cracking unit in order to form a second cracked product.

2. The method of claim 1 wherein the primary feed is at least one of naphtha; hydrocarbonaceous oils boiling in the range of about 430° F. (220° C.) to about 1050° F. (565° C.); heavy hydrocarbonaceous oils comprising materials boiling above 1050° F. (565° C.); heavy and reduced petroleum crude oil; petroleum atmospheric distillation bottoms; petroleum vacuum distillation bottoms; pitch; asphalt; bitumen; hydrocarbon residues; tar sand oils; shale oil; and liquid products derived from coal and natural gas.

3. The method of claim 1 wherein the primary feed catalytic cracking occurs in a continuous fluidized catalytic cracking unit and wherein the catalytic cracking conditions include a reaction temperature ranging from about 500° C. to about 650° C.; a hydrocarbon partial pressure ranging from about 10 to 40 psia; and a catalyst to primary feed (wt/wt) ratio from about 3 to 12, where catalyst weight is total weight of the catalyst.

4. The method of claim 1 wherein the hydroprocessing is conducted under conditions including a hydroprocessing temperature ranging from about 400° to about 900° F.; a hydroprocessing pressure ranging from about 100 to about 3000 psig; a space velocity ranging from about 0.1 to about 6 V/V/Hr; and a hydrogen charge rate ranging from about 500 to about 15,000 standard cubic feet per barrel (SCF/B).

5. The method of claim 4 wherein the hydroprocessed cycle oil contains decahydronaphthalene and alkyl-functionalized derivatives thereof.

6. The method of claim 5 wherein decahydronaphthalene is the most abundant 2-ring species in the hydroprocessed cycle oil and wherein the total aromatics content in the hydroprocessed cycle oil ranges from about 0 to about 5 wt. %, with a total 2-ring or larger aromatic content ranging from about 0 to about 2 wt %.

7. The method of claim 1 wherein the hydroprocessed cycle oil cracking occurs in a second continuous fluidized catalytic cracking unit and wherein the cycle oil catalytic cracking conditions include a second reaction temperature ranging from about 495° C. to about 700° C.; a second hydrocarbon partial pressure ranging from about 10 to 40 psia; and a catalyst to hydroprocessed cycle oil (wt/wt) ratio from about 2 to 100, where catalyst weight is total weight of the catalyst.

8. The method of claim 7 wherein at least 90 wt. % of the second cracked product contains species having atmospheric boiling points less than about 430° F. and wherein the second cracked product contains naphtha in amounts ranging from about 5 wt. % to about 60 wt. %, butanes in amounts ranging from about 0.5 wt. % to about 15 wt. %, butenes in amounts ranging from about 4 wt. % to about 10 wt. %, propane in amounts ranging from about 0.5 wt. % to about 3.5 wt. %, and propylene in amounts ranging from about 5 wt. % to about 15 wt. %, the weight percents being based on the total weight of the second cracked product.

9. The method of claim 1 further comprising combining the hydroprocessed cycle oil with a naphtha prior to the second catalytic cracking.

10. The method of claim 1, further comprising separating a naphtha fraction and a light olefin fraction from the second cracked product.

11. The method of claim 10 wherein the light olefin fraction comprises propylene.

12. The method of claim 11 further comprising polymerizing the propylene.

* * * * *